US010902839B2

(12) United States Patent
Wiles

(10) Patent No.: US 10,902,839 B2
(45) Date of Patent: Jan. 26, 2021

(54) APPARATUS AND METHOD FOR PRIVACY ENHANCEMENT

(71) Applicant: JAGUAR LAND ROVER LIMITED, Coventry (GB)

(72) Inventor: Paul Wiles, Warwickshire (GB)

(73) Assignee: JAGUAR LAND ROVER LIMITED, Warwickshi (GB)

( * ) Notice: Subject to any disclaimer, the term of this patent is extended or adjusted under 35 U.S.C. 154(b) by 0 days.

(21) Appl. No.: 16/494,555

(22) PCT Filed: Mar. 13, 2018

(86) PCT No.: PCT/EP2018/056149
§ 371 (c)(1),
(2) Date: Sep. 16, 2019

(87) PCT Pub. No.: WO2018/172131
PCT Pub. Date: Sep. 27, 2018

(65) Prior Publication Data

US 2020/0135166 A1 Apr. 30, 2020

(30) Foreign Application Priority Data

Mar. 20, 2017 (GB) ..... 1704363.9
Mar. 20, 2017 (GB) ..... 1704364.7

(51) Int. Cl.
*G10K 11/178* (2006.01)

(52) U.S. Cl.
CPC .. *G10K 11/17873* (2018.01); *G10K 2210/108* (2013.01); *G10K 2210/1282* (2013.01);
(Continued)

(58) Field of Classification Search
None
See application file for complete search history.

(56) References Cited

U.S. PATENT DOCUMENTS 4,829,729 A * 5/1989 Derner ..... E06B 3/6707 52/171.3
2011/0182438 A1* 7/2011 Koike ..... G10L 21/04 381/73.1

(Continued)

FOREIGN PATENT DOCUMENTS

EP 3040984 A1 7/2016
EP 3048608 A1 7/2016

OTHER PUBLICATIONS

International Search Report and Written Opinion, PCT/EP18/56149, dated Jun. 1, 2018.
Search and Examination Report, GB1704363.9, dated Sep. 21, 2017.

*Primary Examiner* — James K Mooney
(74) *Attorney, Agent, or Firm* — Miller Nash Graham & Dunn LLP

(57) ABSTRACT

Embodiments of the present invention provide a vehicle privacy system (700), comprising audio input means (130, 190, 720) for receiving an external audio signal (725) indicative of audio from within a vehicle (900), audio source means (710, 910) for receiving the external audio signal (725) and determining an output audio signal (735) in dependence thereon for reducing an external intelligibility of speech within the vehicle (900), and audio output means (145, 146, 147, 730, 920) for receiving the output audio signal (735) and outputting audio (925) corresponding thereto to be at least partly audible external to the vehicle (900).

19 Claims, 8 Drawing Sheets

(52) U.S. Cl.
CPC ..... *G10K 2210/3027* (2013.01); *G10K 2210/3056* (2013.01)

(56) References Cited

U.S. PATENT DOCUMENTS

2013/0185065 A1 7/2013 Tzirkel-Hancock et al.
2015/0137998 A1* 5/2015 Marti ..... H04K 3/825 340/901

* cited by examiner

APPARATUS AND METHOD FOR PRIVACY ENHANCEMENT

CROSS-REFERENCE TO RELATED APPLICATIONS

This application is a 371 of International Application No. PCT/EP2018/056149, filed Mar. 13, 2018, which claims priority to GB Patent Application 1704363.9 filed Mar. 20, 2017, and GB Patent Application 1704364.7 filed Mar. 20, 2017, the contents of all of which are incorporated by reference herein in their entirety.

TECHNICAL FIELD

The present disclosure relates to an apparatus and method for privacy enhancement. Aspects of the invention relate to a system, to a controller, to a method, to a vehicle and to computer software.

BACKGROUND

It is known to provide communication functionality within vehicles, such as an ability for the vehicle to connect to a mobile telephone of an occupant to provide hands-free call functionality, or to integrate a mobile telephone into the vehicle. Other communications technologies are known or envisaged, such as Voice Over IP (VOIP) communications. In these cases, the occupant of the vehicle is able to speak to, and hear audio from, a remote party. The audio from the remote party is output within the vehicle. However it is often observed that such audio may be heard by persons external to the vehicle, limiting privacy of the communication. It is also observed that other audio, such as music, may be heard external to the vehicle which may be annoying for persons external to the vehicle.

It is an object of embodiments of the invention to at least mitigate one or more of the problems of the prior art.

SUMMARY OF THE INVENTION

Aspects and embodiments of the invention provide an in-vehicle privacy system, a controller, a method, computer software and a vehicle as claimed in the appended claims.

According to an aspect of the invention, there is provided an in-vehicle privacy system, comprising means for outputting a signal indicative of audio external to the vehicle, and control means for initiating one or more actions in dependence on the determination of an audio volume external to the vehicle for reducing said volume.

According to an aspect of the invention, there is provided an in-vehicle privacy system, comprising means for outputting a signal indicative of audio external to the vehicle, and control means for outputting a notification to a user in dependence on a determination of an audio volume external to the vehicle. The signal may be indicative of audio external to the vehicle which has emanated from within a cabin of the vehicle.

According to an aspect of the present invention, there is provided a method, comprising determining an external volume of audio output within an interior of a vehicle, determining a volume threshold in dependence on the one or more parameters of the vehicle; and outputting a notification to an occupant of the vehicle indicative of the threshold and the external volume. The notification may be visually output. The notification may comprise a first portion indicative of the external volume and a second portion indicative of the volume threshold.

According to an aspect of the present invention, there is provided a vehicle privacy system, comprising audio output means associated with an interior of a vehicle, audio source means for providing an audio signal to the audio output means, external means for outputting a signal indicative of audio external to the vehicle, and control means arranged to determine an amplitude of audio external to the vehicle, corresponding to the audio signal, and to initiate one or more actions in dependence on the determination of the amplitude, to reduce the amplitude of the audio external to the vehicle. The vehicle privacy system provides the advantage that an amplitude of the audio external to the vehicle may be controlled or reduced. The audio external to the vehicle may be reduced, such that the audio external to the vehicle is less noticeable.

In an embodiment of the vehicle privacy system as described above:

- the audio output means is an audio output device, such as a speaker;
- the audio source means an audio source device;
- the external means is an external audio input device, such as an a microphone; and
- the control means is a controller or control device.

The amplitude of the audio external to the vehicle corresponding to the audio signal may be that which is output by the audio output means within the interior of the vehicle and which is at least partly audible external to the vehicle.

The external means may be arranged to receive a signal indicative of an amplitude of audio internal to the vehicle and to estimate the audio external to the vehicle. The external means may estimate an amplitude of the audio external to the vehicle.

The control means may be arranged to determine a speech intelligibility external to the vehicle. The control means may be arranged to initiate the one or more actions, in dependence on the determination of the speech intelligibility, to reduce the speech intelligibility external to the vehicle. This provides the advantage that the audio external to the vehicle may be controlled to reduce the speech intelligibility. In this way, speech is less understandable external to the vehicle.

The audio source means may comprise a communication system and the control means is arranged to determine the speech intelligibility of speech output by the communication system external to the vehicle. Thus, the intelligibility of communicated speech may be controlled. In this way, communications with the vehicle may be more secure.

The external means optionally comprises a sensor means arranged to determine the amplitude of the audio external to the vehicle. Therefore, the intelligibility of speech external to the vehicle may be measured rather than, for example, inferred.

The control means may be arranged to receive data indicative of one or more parameters of the vehicle and to initiate the one or more actions in dependence on the amplitude of the audio and a threshold determined in dependence on the one or more parameters of the vehicle. The one or more parameters may be used to determine the threshold for controlling the amplitude of audio.

Optionally the one or more parameters comprise one or more of: a speed of the vehicle; an engine speed of the vehicle; and a motor speed of the vehicle. Accordingly, one or more operating characteristics of the vehicle may be taken into account for the determination of the threshold.

The system may comprise a location determining means for determining a location of the vehicle. The control means may be arranged to initiate the one or more actions, in dependence on the determination of the amplitude of the audio external to the vehicle and the location of the vehicle. This is beneficial in that the threshold may be determined appropriate for an environment of the vehicle.

The one or more actions optionally comprise controlling an amplitude of one or more frequency bands of the audio signal. Hence, the one or more frequency bands most effective for controlling the external amplitude may be controlled.

The one or more actions may comprise controlling a frequency profile of the audio signal. The frequency profile may be controlled to be effective for controlling the external amplitude.

The frequency profile may be controlled to reduce an amplitude of one or more low frequency bands in the audio signal. Controlling the lower frequency bands may be most effective for controlling the external amplitude.

The audio output means optionally comprises a plurality of audio output devices. The one or more actions may comprise controlling an amplitude of the audio signal output by at least some of the plurality of audio output devices. Thus, the amplitude of the audio output by some of the audio output device may be controlled to be most effective at controlling the external amplitude.

The controlling of the amplitude may comprise selectively deactivating one or more of the audio output devices. Some of the audio output devices may therefore be deactivated to control the external amplitude in a simple and effective manner.

Optionally the estimate of speech intelligibility is an Articulation Index, AI. The AI may provide an effective measure of the external speech intelligibility.

The one or more actions may comprise repositioning one or more aperture members of the vehicle. Accordingly, the one or more aperture members may effectively reduce the external amplitude.

According to an aspect of the present invention, there is provided a controller for a vehicle privacy system, the controller comprising input means for receiving a signal indicative of audio external to a vehicle, the controller being arranged to determine an external amplitude of audio with respect to the vehicle, corresponding to audio output within the vehicle, and, in dependence thereon, to initiate one or more actions, the controller further comprising output means for outputting at least one signal indicative of the one or more actions for reducing the external amplitude of the audio.

In an embodiment of the controller as described above:

the input means is an electrical input for receiving the signal indicative of audio external to a vehicle; and the output means is an electrical output for outputting the at least one signal indicative of the one or more actions. The controller may comprise one or more processing devices for operably executing computer-readable instructions. The instructions may be stored in a memory of, or accessible to, the controller.

The controller may be arranged to estimate a speech intelligibility external to the vehicle in dependence on the received signal and to initiate the one or more actions in dependence thereon.

The controller is optionally arranged to receive data indicative of one or more parameters of the vehicle and to estimate the speech intelligibility in dependence thereon.

Optionally the controller is arranged to control an amplitude of one or more frequency bands of the audio signal.

The one or more actions may comprise controlling a frequency profile of the audio signal.

The one or more actions optionally comprise controlling an amplitude of the audio signal output by at least some of a plurality of audio output devices within the vehicle.

The one or more actions optionally comprise repositioning one or more aperture members of the vehicle.

According to an aspect of the present invention, there is provided a method comprising determining an amplitude of audio external to the vehicle corresponding to audio output within an interior of a vehicle, and initiating one or more actions, in dependence on the determination of the amplitude of audio external to the vehicle, for reducing the amplitude of the audio external to the vehicle.

The method may comprise estimating a speech intelligibility of audio external to the vehicle. The method may comprise initiating the one or more actions in dependence on the estimate of speech intelligibility.

The method may comprise receiving data indicative of one or more parameters associated with the vehicle. The method may comprise determining a threshold amplitude in dependence on the one or more parameters of the vehicle. The method may comprise initiating the one or more actions in dependence on the amplitude of the audio external to the vehicle and the threshold amplitude.

Optionally the one or more parameters comprise one or more of: a vehicle speed; an engine speed of the vehicle; and a motor speed of the vehicle.

The method may comprise determining a location of the vehicle. The method may comprise determining the threshold amplitude in dependence on the location and the one or more parameters of the vehicle.

The method may comprise initiating the one or more actions in dependence on the threshold amplitude and the estimate of the speech intelligibility.

The one or more actions may comprise controlling a frequency profile of the audio output within the interior of the vehicle; optionally the frequency profile is controlled to reduce a volume of one or more frequency bands in the output audio.

The one or more actions optionally comprise controlling a volume of the audio output by at least some of a plurality of audio output devices within the vehicle.

According to an aspect of the invention, there is provided a vehicle privacy system, comprising audio input means for receiving an external audio signal indicative of audio from within a cabin of a vehicle, audio source means for receiving the external audio signal and determining an output audio signal in dependence thereon for reducing an external intelligibility of speech within the cabin of the vehicle, and audio output means for receiving the output audio signal and outputting audio corresponding thereto to be at least partly audible external to the cabin of the vehicle. This provides the benefit that the output audio controls or reduces the external audio from within the cabin of the vehicle. The output audio may interact with the audio from within the cabin of the vehicle such that the resultant amplitude of audio is reduced.

The external audio may be that which emanates externally from within the cabin of the vehicle. Thus, the external audio signal may be indicative of audio externally emanating from within the cabin of the vehicle. Advantageously the external audio signal may provide information about audio from within the cabin which is audible external to the vehicle i.e. outside the cabin.

In an embodiment of the vehicle privacy system as described above:

the audio input means is an electrical input for receiving the external audio signal;

the audio source means is an audio source device;

the audio output means is one or more audio output devices, such as speakers. The external audio signal may be provided by one or more one or more vibro-acoustic audio input devices, such as microphones.

It will be understood that being at least partly audible external to the vehicle includes the audio corresponding to the output audio signal cancelling with one or more audible signals external to the vehicle, such that a combination of the audible signals has a reduced volume or amplitude.

The vehicle privacy system may comprise control means arranged to selectively cause the audio output means to output audio corresponding to the output audio signal. Accordingly, the audio may be only selectively output at occasions when necessary to reduce the amplitude of audio from within the cabin of the vehicle.

The audio input means may be arranged to determine audio internal to the cabin of the vehicle. Hence, the audio internal to the cabin may be determined. The determination may be by inference or measurement.

The audio input means is optionally arranged to determine audio external to the cabin of the vehicle. The audio input means may comprise a vibro-acoustic device, such as a microphone. This provides the advantage that the audio external to the cabin may be determined which may be more accurate. In some instances, the audio external to the cabin may be measured.

The audio input means may be arranged to receive the external audio signal from a communication system or a voice output system. Accordingly, the external audio signal may be provided from an electronic source of the audio internal to the cabin.

The communication system may be one of a telephony communication system, a Voice Over IP, VOIP, communication system, or a text-to-speech communication system. This provides the advantage that the external amplitude of electronic communications with the vehicle may be reduced.

The audio source means is optionally arranged to determine the output audio signal as an external sound cancellation signal for at least a portion of the external audio signal. In this manner the output audio signal operates to at least partly cancel or reduce an amplitude of the external audio signal.

Optionally the portion of the external audio signal is a portion corresponding to speech within the cabin of the vehicle. This is beneficial because an amplitude or volume of speech may be effectively controlled.

The audio output means may comprise one or more audio output means arranged to output audio predominantly external to the cabin of the vehicle. Thus, the external output of audio is effective at controlling the external amplitude.

The audio output means optionally comprises vibration means for vibrating at least a portion of the vehicle to output audio external to the vehicle. A portion of the vehicle may be used to control the audio external to the vehicle.

The vibration means may be arranged to vibrate one or more of a structure of at least a portion of the vehicle, or one or more external surfaces of the vehicle. Hence, additional audio output means may not be required.

The structure of at least the portion of the vehicle optionally comprises a structure of a door of the vehicle. The one or more external surfaces of the vehicle may comprise one or more body panels or windows of the vehicle. Said portions of the vehicle are effective at outputting audio when vibrated.

The control means may be arranged to determine a speech intelligibility external to the vehicle, and to cause the audio source means to output the output audio signal to the audio output means in dependence on the determination of the speech intelligibility. In this manner the audio is output when speech is intelligible.

The estimate of speech intelligibility optionally comprises an Articulation Index, AI. The AI may provide an effective indication of speech intelligibility.

According to an aspect of the invention, there is provided a method, comprising determining an external audio signal corresponding to audio from within a cabin of a vehicle, determining an output audio signal in dependence on the external audio signal for reducing an external intelligibility of speech within the cabin of the vehicle, and outputting audio corresponding to the output audio signal to be at least partly audible external to the cabin of the vehicle.

The method may comprise determining the external audio signal indicative of the audio which is externally emanating from within the cabin.

The method may comprise determining whether to selectively output the audio corresponding to the output audio signal.

The external audio signal may be determined internal to the cabin of the vehicle.

The external audio signal is optionally determined external to the cabin of the vehicle.

The determining external audio signal may comprise receiving an audio signal from a communication system associated with the vehicle.

Optionally the determining external audio signal comprises measuring audio one or both of internal to, or external to, the cabin of the vehicle.

The output audio signal may be determined as an external sound cancellation signal for the speech within the vehicle.

The outputting the output audio signal may comprise vibrating at least a portion of the vehicle to output audio external to the vehicle.

The vibrating at least a portion of the vehicle may comprise exciting one or more of a structure at least a portion of the vehicle or one or more external surfaces of the vehicle.

The method optionally comprises determining a speech intelligibility external to the vehicle, wherein the output audio signal is output in dependence on the determination of the speech intelligibility. Optionally the estimate of speech intelligibility is an Articulation Index, AI.

According to an aspect of the invention, there is provided a controller for a vehicle privacy system, the controller comprising input means for receiving an external audio signal indicative of audio from within a cabin of a vehicle, processing means for determining an output audio signal in dependence on the external audio signal for reducing an external intelligibility of speech within the cabin of the vehicle, and output means for outputting the output audio signal to audio output means.

In an embodiment of the controller as described above:

the input means is an electrical input for receiving the external audio signal; and the output means is an electrical output for outputting the output audio signal.

The controller may comprise one or more processing means in the form of one or more processing devices for operably executing computer-readable instructions. The instructions may be stored in a memory of, or accessible to, the controller.

The output audio signal may be determined as a sound cancellation signal for the speech within the cabin of the vehicle.

According to an aspect of the invention, there is provided computer software which, when executed by a computer, is arranged to perform a method according to an aspect of the invention described hereinbefore. The computer software may be stored on a computer readable medium. Optionally, the computer readable medium comprises a non-transitory computer readable medium.

According to an aspect of the invention, there is provided a vehicle comprising a system according to an aspect of the invention, arranged to perform a method according to an aspect of the invention, a controller according to an aspect of the invention, or comprising computer software according to an aspect of the invention.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

One or more embodiments of the invention will now be described by way of example only, with reference to the accompanying drawings, in which.

DETAILED DESCRIPTION

Figure 1:
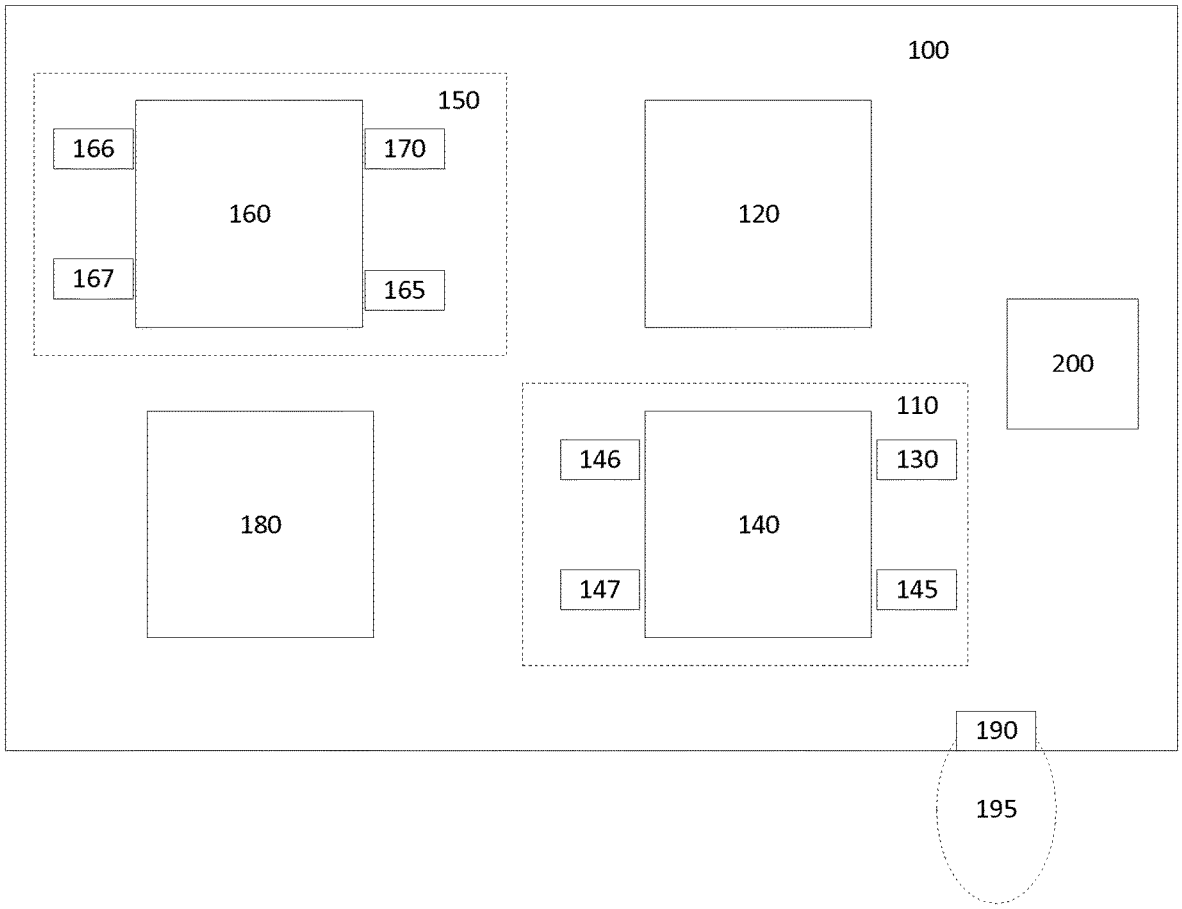
FIG. 1 schematically illustrates a vehicle comprising a system according to an embodiment of the invention.

FIG. 1 schematically illustrates a vehicle 100 according to an embodiment of the invention. The vehicle 100 comprises a plurality of seating positions 120, 140, 160, 180. Four seating positions are illustrated, in a two-by-two arrangement, although it will be realised that this is merely an example and that other numbers of seating positions, such as five seating positions, and in other arrangements, such as two by three, may be envisaged. Each seating position 120, 140, 160, 180 is associated with a respective seat for an occupant of the vehicle 100.

First and second seats 120, 140 are front seats of the vehicle 100 whilst third and fourth seats 160, 180 are rear seats of the vehicle 100. The second and third seats 140, 160 are shown as being associated each with a respective zone 110, 150 of the vehicle, which may be known as an infotainment zone. Each zone of the vehicle may be a subset or portion of the interior of the vehicle 100. In some embodiments, it is desired that audio content within one zone is insulated or contained within that zone. However in other embodiments the vehicle 100 may have only one zone which encompasses some or all of the seating positions 120, 140, 160, 180 of the vehicle 100. Thus it will be appreciated that only one zone is associated with the vehicle 100 in some embodiments.

As illustrated in FIG. 1 the vehicle 100 comprises two zones, namely a first zone 110 and second zone 150. The vehicle 100 may comprise other numbers of zones, such as one, three or four zones. However description will be provided as an example with reference to the two illustrated zones, although the invention is not restricted in this respect.

The first zone 110 is associated with a front-seat occupant of the vehicle 100, which may be a driver of the vehicle 100 in a right-hand drive configuration of vehicle 100. The second zone 150 is associated with a rear-seat occupant of the vehicle 100. It will be appreciated that there is not necessarily a one-to-one correspondence of zones to seats of vehicle i.e. a zone may be associated with a plurality of seats of the vehicle 100, such as front or rear seats of the vehicle.

An occupant of the vehicle 100 may take (receive and make) calls with a remote party whilst travelling in the vehicle 100. The occupant may take the call via an in-car hands-free system of the vehicle 100, as will be explained. During such a call one or more audio output means within the vehicle 100 are used to output audio corresponding to the remote party. It is desired to prevent speech of the remote party on the call being intelligible to persons external to the vehicle 100. The output audio within the vehicle 100 may be particularly heard by persons external to the vehicle due to placement of the audio output means within the vehicle adjacent to an outer skin of the vehicle 100, such as within a door panel of the vehicle, for example.

The first zone 110 is associated with audio output means 145, 146, 147. The second zone is associated with audio output means 165, 166, 167. The audio output means 145, 146, 147, 165, 166, 167 may arranged to output audio predominantly to an occupant of each respective zone 110, 150. However in some embodiments having only one zone the audio output means 145, 146, 147, 165, 166, 167 may be arranged to output audio to the entire vehicle 100 interior. In the illustrated multi-zone embodiment, the audio output means 145, 146, 147 of the first zone 110 is arranged, in use, for outputting different audio to that output by the audio output means 165, 166, 167 of the second zone 150. In some embodiments, at least some of the audio output means 146, 147, 166, 167 of each zone are mounted within or on a seat. For example, the audio output means 146, 147, 166, 167 may be arranged within or on an upper region of each seat, such as in headrest of each seat 140, 160 to direct output audio toward the seat occupant's ears, thereby aiding audio isolation with each zone 110, 150. The headrest may be moveably mounted with respect to a body of the seat. However the headrest does not need to be a separate component of the seat from a body of the seat. The headrest may be a region of the seat which is integrated with the body of the seat and proximal to an occupant's head when sat upon the seat. Other mounting locations for the audio output means 145, 146, 147, 165, 166, 167 are envisaged such as within the seat body, or within or behind interior trim of the vehicle 100. The audio output means 145, 146, 147, 165, 166, 167 may each be a speaker for outputting audible sounds based on received electrical signals, as will be appreciated.

In the illustrated embodiment, the first zone 110 is associated with a first speaker 145 which may be mounted about a door panel of the vehicle 100. The first zone is also associated with second and third speakers 146, 147 which, as noted above, may be mounted within or on a headrest of the second seat 140. It will be appreciated that these mounting locations are merely an example and that others may be envisaged. The second zone 150 is associated with a first speaker 165 which may be mounted about a door panel of the vehicle 100. The second zone 150 is also associated with second and third speakers 166, 167 which are mounted within or on a headrest of the third seat 160. It will be appreciated that these mounting locations are merely an example and that others may be envisaged.

In some embodiments, one or more zones 110, 150 of the vehicle are associated with audio input means. In the illustrated embodiment, the first zone 110 is associated with a first audio input means 130. The first audio input means 130 is provided for outputting an electrical signal indicative of audio within the first zone 110. The audio input means 130 may be a first microphone 130. Similarly, in the illustrated embodiment, the second zone 150 comprises a second audio input means 170. The second audio input means 170 is provided for outputting an electrical signal indicative of audio within the second zone 150. The audio input means may be a second microphone 170. The first and second microphones 130, 170 may be used for facilitating a call with a remote party. In some embodiments, occupants of both the first and second zones 110, 150 may be joined in the call, whilst in other embodiments the occupant of only one of the zones 110, 150 may take part in the call. Whilst embodiments of the invention are described with reference an audio call, it will be appreciated that embodiments of the invention encompass a call including video of which the audio forms part.

Embodiments of the invention will be further described with reference to the first zone 110 of the vehicle 100, the audio output means 145, 146, 147 and the audio input means 130 associated with the first zone 110. However it will be realised that embodiments of the invention may comprise other zones of the vehicle, such as the second zone 150, or with a vehicle not having multiple zones i.e. having a single interior zone.

The vehicle 100 comprises external means 190 for determining audio external to the vehicle 100. In some embodiments, the external means 190 may be one or more sensors for determining audio external to the vehicle 100. The external means 190 may, in one embodiment, be one or more external audio input means 190 arranged to output an electrical signal indicative of audio external to the vehicle 100. The external audio input means 190 may be one or more external microphones 190. In FIG. 1 the vehicle is illustrated as being associated with one external microphone 190, although it will be appreciated that this is merely illustrative and that the vehicle 100 may be associated with a plurality of external microphones. In some embodiments, the plurality of external microphones 190 may be distributed about the vehicle 100 such that each external microphone is arranged to determine audio from a respective region external to the vehicle 100. The external microphone 190 illustrated in FIG. 1 is shown being located proximal to the first zone 110 for illustration with it being appreciated that the one or more external microphones 190 may be located in other locations. The one or more external microphones may be arranged about the vehicle 100 to have a sensitive region 195, i.e. a region 195 from which the external microphone 190 determines audio, being external to the vehicle 100, such as extending outward from the vehicle 100. In some embodiments the region 195 may be external to a portion of the vehicle 100 adjacent or proximal to the zone 110. Thus it will be realised that the external microphone does not itself need to be mounted external to the vehicle 100 in order to receive audio therefrom. In one embodiment, the external microphone 190 is located behind a protective cover such as a portion of the vehicle's body. In particular, in one embodiment, the external microphone 190 may be arranged in a wheel arch region of the vehicle 100. In some embodiments, each wheel arch of the vehicle 100 is associated with a respective external microphone 190.

In other embodiments, the external means 190 comprises an electrical input arranged to receive a signal indicative of audio output internal to the vehicle from which the audio external to the vehicle 100 may be estimated. The electrical signal may be indicative of a volume setting or output amplitude of audio output into a cabin or occupant compartment of the vehicle i.e. interior to the vehicle 100. The audio may be output into the cabin of the vehicle 100 such as from a communication or entertainment system of the vehicle. The audio external to the vehicle 100 may be determined by estimating an attenuation of the audio internal to the vehicle 100 provided by the vehicle body, such that the audio external to the vehicle is estimated in dependence on the volume setting or output amplitude of the internal audio.

The vehicle 100 further comprises a control means in the form of a controller 200. The controller 200 may be communicably coupled to the first microphone 130, audio output means 145, 146, 147, of the first zone 110 and the external microphone 190. It will be appreciated that the controller 200 may also be communicably coupled with the second microphone 170 and audio output means 165, 166, 167 of the second zone 150. Some embodiments may comprise alternative or additional communicable connections with the controller 200 as will be explained.

The controller 200 is arranged to communicate with the external microphone 190 to determine a volume external to the vehicle 100 of audio output by one or more audio output means 145, 146, 147, 165, 166, 167 within the vehicle 100. It will be understood that the volume of the audio corresponds to an amplitude or strength of the audio.

The controller 200 is arranged to initiate one or more actions, in dependence on the determination of the volume, to reduce the volume of the audio external to the vehicle 100, as will be explained. In some embodiments, the controller 200 is arranged to determine speech intelligibility external to the vehicle 100.

Figure 2:
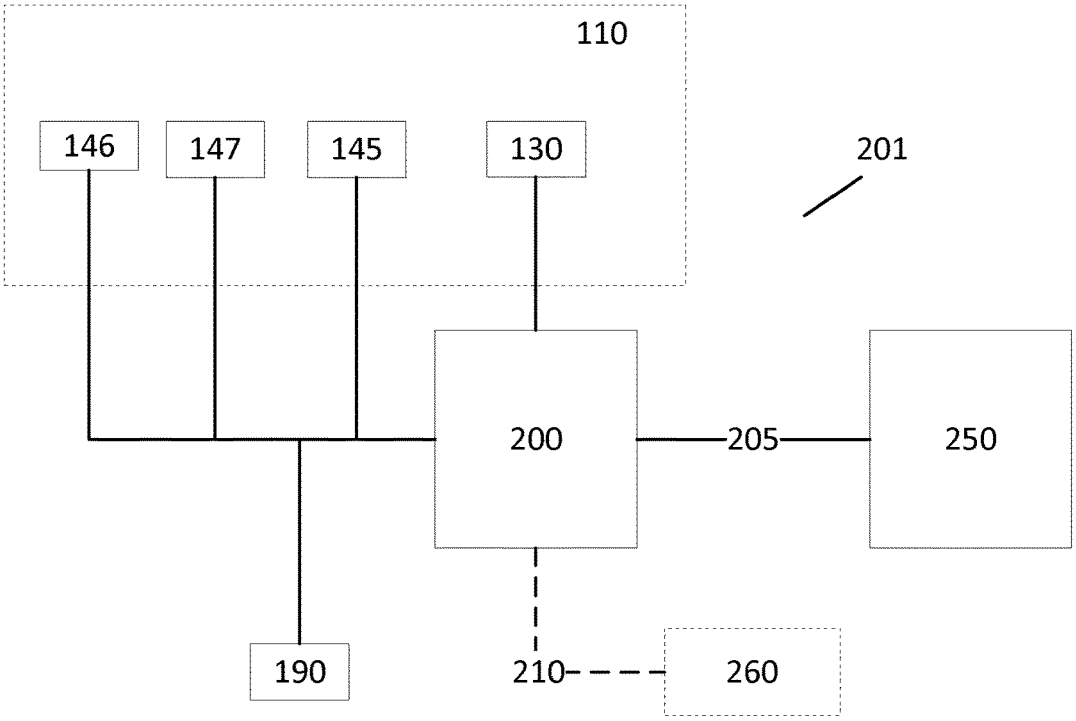
FIG. 2 shows a system according to an embodiment of the invention.

FIG. 2 illustrates a system 201 according to an embodiment of the invention. The system 201 comprises the controller 200 according to an embodiment of the invention. The controller 200 is an in-vehicle privacy controller 200 according to an embodiment of the invention. The controller 200 is arranged to control an external volume of audio output within the vehicle 100 according to an embodiment of the invention.

The controller 200 may be implemented as an electronic device comprising one or more processors operative to execute computer software instructions which may be stored in a memory accessible to the one or more processors, such as a memory device of the controller 200. The controller 200 may be communicably coupled to a communication bus 210 of the vehicle 100 to exchange, i.e. to send and/or receive data, with other units or modules communicably coupled with the communication bus 210. The communication bus 210 may be implemented by, for example, a communication network such as one of CAN bus, Ethernet or Flexray, although other protocols may be envisaged.

The system 201 further comprises the audio output means 145, 146, 147 associated with at least one zone 110 which, in the illustrated embodiment, is the first zone 110 of the vehicle 100. It will be appreciated that the controller 200 may be associated with audio output means of more than one zone, such as also the second zone 150, as noted above. The controller 200 is arranged, in use, to cause the audio output means 146, 147 to output audible signals i.e. sound waves. The controller 200 comprises an output means, which may be in the form of an electrical output for outputting the audio signal, to the audio output means 146, 147 which may each be a speaker within the vehicle 100 associated with the first zone 110.

In some embodiments, as noted above, the system 201 further comprises first audio input means 130 for providing a signal to the controller 200 indicative of audible signals in the first zone 110. The audio input means 130 may be a microphone 130 associated with the first zone 110. The controller 200 comprises an input means, such as an electrical input, for receiving an electrical signal from the microphone 130 corresponding to audio detected by the microphone 130.

The system 201 further comprises audio source means 250 for providing an audio signal 205. The audio source means 250 is coupled to the controller 200 by an electrical input of the controller 200 for receiving the audio signal 205. The audio source means 250 may be an audio source device for providing the audio signal 205 to the controller 200. The audio signal 205 may be received from a source of audio, which may be provided from one or a combination of a music source, a radio or a streaming audio source. The source of audio may be an entertainment system of the vehicle 100 which is capable of receiving radio, digitally streamed music or audio (such as audiobooks), such as over the Internet, or reproducing stored audio for example from a CD, DVD, memory device or other storage medium. The audio source means 250 may comprise a communication system of the vehicle 100, wherein the communication system is capable of operatively supporting a call with the remote party, such as via a telecommunications network. The telecommunications network may be a cellular network such as complying with a predetermined standard such as 4G, LTE, 5G or other standard. The call may be supported by data communication such as a VOIP call. Furthermore, the call may comprise a video component.

The controller 200 may be communicably coupled to one or more systems of the vehicle 100 via the communication bus 210. The one or more systems may comprise an aperture control means 260 for controlling a position of one or more aperture members of the vehicle 100. Each aperture member may be repositioned to control a size of a vehicle aperture. In particular, the aperture member may be repositioned to either increase or decrease the size of opening of the vehicle aperture. The vehicle aperture may comprise a window of the vehicle and, in some embodiments, an opening roof of the vehicle, such a sunroof or convertible roof of the vehicle 100. In these examples, the aperture member is a transparent or translucent pane of the window, which may be made from glass, or a roof member which may be made from fabric or one or more rigid panels.

The one or more systems may comprise a position determining means for determining a geographic position of the vehicle 100. The position determining means may be arranged to receive wireless signals for determining the geographic location based thereon, wherein the wireless signals may comprise navigation signals broadcast by one or more satellites and wireless network signals, such as WiFi, from which the location of the vehicle may be determined for example according to an identification of the wireless network. The location determining means may comprise a receiver device such as a Global Satellite Navigation System (GNSS) receiver or a Global Position System (GPS) receiver, although other receiver devices such as for GLONASS may be used. Location information indicative of the geographic location of the vehicle 100 may be communicated from the location determining means to the controller 200 via the communication bus 210.

In some embodiments, the one or more systems may comprise a user interface for communicating information to an occupant of the vehicle 100, such as an occupant associated with the first zone 110 although it will be realised that the user interface may be associated with other occupants. The user interface may comprise a visual display device for visually outputting information thereon.

Figure 3:
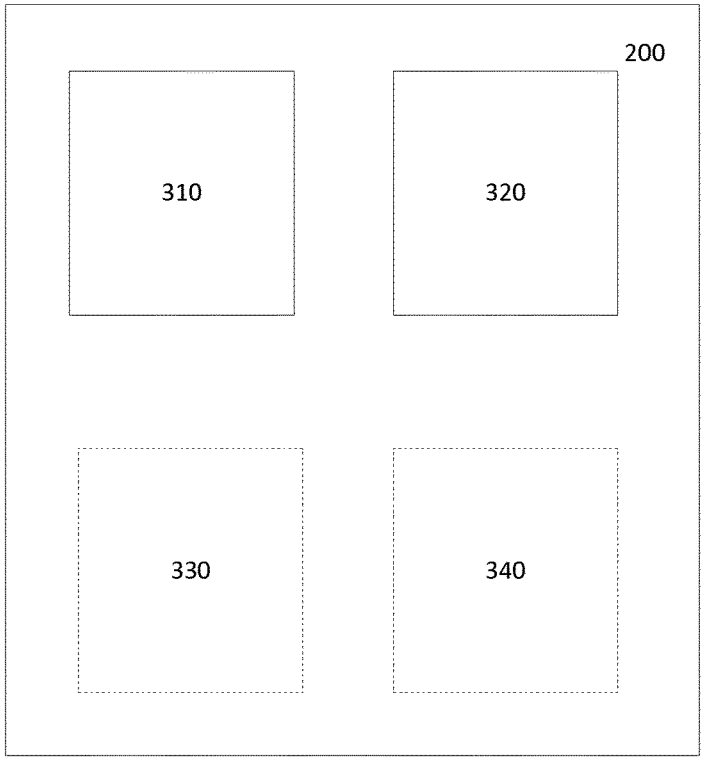
FIG. 3 shows a controller and modules according to an embodiment of the invention.

FIG. 3 illustrates modules which operatively execute on the controller 200 according to an embodiment of the invention. The modules may be implemented as software which is executed by the one or more processing means of the controller 200.

A volume determination module (VDM) 310 is provided for operatively determining a volume of audio external to the vehicle 100. The VDM 310 is arranged to receive the signal indicative of audio external to the vehicle 100 from the external microphone 190. The VDM 310 may further receive an internal audio signal indicative of audio output within the vehicle 100. The internal audio signal may be directly received from the audio source means 250, corresponding to which audio is output within the vehicle 100, or the internal audio signal may be provided from an audio input means 130, 170 within an interior of the vehicle 100, such as the first audio input means 130 associated with the first zone 110. The VDM 310 may operatively determine a correspondence between the external audio signal and the internal audio signal. The correspondence is indicative of an extent to which audio output within the vehicle 100 is heard external to the vehicle 100. In one embodiment the VDM 310 is arranged to compare the external audio signal and the internal audio signal. The comparison may comprise determining a corresponding portion of the external audio signal which corresponds to the internal audio signal. In this way, the extent to which audio output within the vehicle 100 by the one or more audio output means 145, 146, 147, 165, 166, 167 is audible external to the vehicle 100 is determined. Thus, 'external audio' as used herein may be understood to mean audio external to the vehicle 100 which is contributed by audio output within the vehicle 100. This is in contrast to audio which may be heard external to the vehicle 100 generally, such as from other sources.

The external audio signal, particularly an amplitude thereof, may be compared against an external volume threshold. The comparison may be performed by the VDM 310. If the external audio signal exceeds the external volume threshold, the VDM 310 may output an excess volume signal indicative of the excess external audio volume.

In some embodiments, a signal indicative of the external audio may be provided to a speech intelligibility module (SIM) 340, as will be explained. In some embodiments, the VDM 310 is arranged to determine the volume of the external audio in a plurality of frequency bands and the signal provided to the SIM 340 is indicative of the volume of the external audio in each of the plurality of frequency bands.

An external volume mitigation module (EVMM) 320 is provided for operatively initiating one or more actions to reduce the audio external to the vehicle. The EVMM 320 may receive the excess signal volume signal from the VDM 310 and initiate the one or more actions in dependence thereon. In some embodiments, the actions may comprise non-physical actions, such as may be performed electronically (rather than mechanically), or physical actions such as closing one or more apertures of the vehicle. In some embodiments, the EVMM 320 may cause an indication of the excess external audio volume to be output to one or more occupants of the vehicle 100. The indication may be one of visually output, audibly output, output as a tactile signal, or a combination thereof. A visual indication may be output on one or more display means, such as one or more display devices, within the vehicle 100, such that it can be observed by one or more occupants of the vehicle 100.

Some embodiments of the invention may comprise a threshold determination module (TDM) 330. The TDM 330 may operatively determine the external volume threshold. The TDM 330 may receive the signal indicative of external audio in each of the plurality of frequency bands from the VDM 310. The external volume threshold may be determined based on one or both of a speed of the vehicle 100, a location of the vehicle 100, and/or a speed of a primary mover of the vehicle, for example an engine and/or motor of the vehicle.

Figure 4:
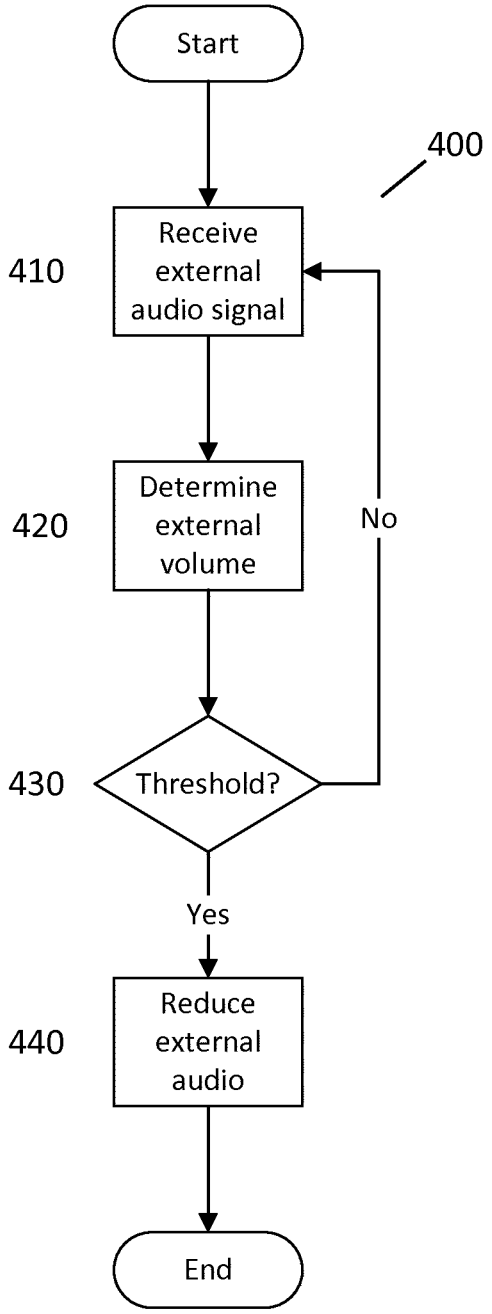
FIG. 4 shows a method according to an embodiment of the invention.

FIG. 4 illustrates a method 400 according to an embodiment of the invention. The method 400 is a method of enhancing in-vehicle privacy. In particular, the method may be a method of controlling external audibility of audio output within a vehicle 100. The method 400 may be performed by the system 201 and controller 200 described above in connection with FIGS. 2 and 3.

The method 400 comprises a step 410 of receiving an external audio signal. The external audio signal may be the signal output by the external microphone 190. The signal may be received at the controller 200, such as via an electrical input thereof. In some embodiments the signal is received in step 410 as a plurality of data packets at the controller 200. Step 410 may comprise receiving the internal audio signal indicative of audio output within the vehicle 100, as described above.

The method 400 comprises a step 420 of determining a volume of external audio. As noted above, external audio may be understood to mean audio external to the vehicle 100 which is contributed by audio output within the vehicle 100. Thus step 420 may comprise determining a correspondence between the external audio signal and the internal audio signal received in step 410. Step 420 may comprise comparing the external audio signal and the internal audio signal. The comparison may comprise determining a portion of the external audio signal which corresponds to the internal audio signal, thereby identifying audio external to the vehicle having originated within the vehicle 100. Thus step 420 comprises determining an external volume of audio output within an interior of a vehicle.

Step 430 of the method 400 comprises comparing the external audio volume against a threshold. In some embodiments the threshold is a predetermined threshold. In some embodiments, the threshold is determined in dependence on one or more parameters associated with the vehicle. However in other embodiments the threshold is dynamically determined based upon the one or more parameters. The one or more parameters may comprise a speed of the vehicle 100, a location of the vehicle 100, a speed of an engine and/or motor of the vehicle. Determination of the threshold may be performed by the TDM 330 illustrated in FIG. 3.

The location of the vehicle 100 may be determined based on received wireless signals, such as GPS signals. The determined location may be compared against map data, which may be stored locally at the vehicle 100 or remotely such as in a remote storage device i.e. on a remote server computer which is accessed via a wireless data connection. The comparison with the map data may be performed to determine whether the location corresponds to one or more categories of location, such as car park, rural, residential, etc. it will be appreciated that this list is not exhaustive and that additional and alternative categories of location may be envisaged. Each of the categories of location may have an associated external volume threshold. For example, a residential category may be associated with an external volume threshold lower than, for example, a car park or rural location. The threshold may be indicative of an expected tolerance of that location to noise i.e. that it would be desirable to be quieter in a residential location than a rural location.

One or more of the speed of the vehicle, the speed of the engine of the vehicle or the speed of a motor of the vehicle may be used to determine the threshold. The threshold may be determined to be higher based on the speed of the vehicle 100 on the basis that if the vehicle is travelling at 10 $kmh^{-1}$ external audio may be heard by a person external to the vehicle for an appreciable time, whereas if the vehicle 100 is travelling faster, the time during which the external audio may be heard by the person external to the vehicle is reduced. Furthermore, the vehicle 100 may produce more noise itself, such as tyre or road noise, at greater speeds which obscure noise originating from within the vehicle 100. Similarly, the speed of the engine and/or motor may obscure noise from within the vehicle 100.

In step 430, if the external audio is determined to be less than the threshold, the method returns to step 410. Thus no action may be taken if the external audio is not equal to or greater than the threshold. If, however, in step 430 the external audio volume, or amplitude of the external audio signal, equals or exceeds the threshold, the method moves to step 440.

Step 440 comprises initiating one or more actions for reducing the volume of the audio external to the vehicle 100. The one or more actions may be initiated by the EVMM 320.

Figure 5A:
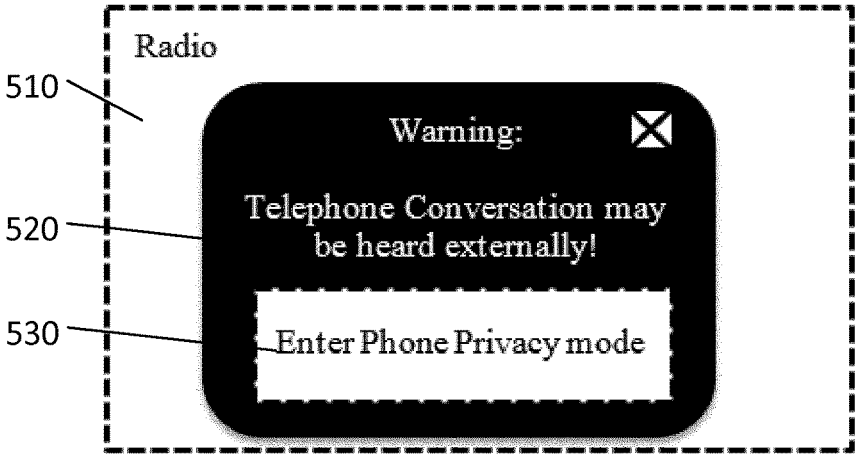
FIG. 5 shows notifications according to an embodiment of the invention.
Figure 5B:
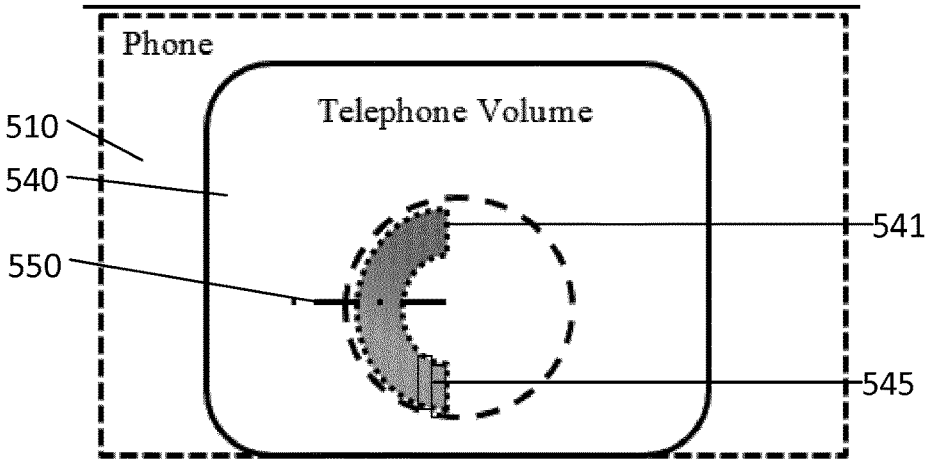
Figure 5C:
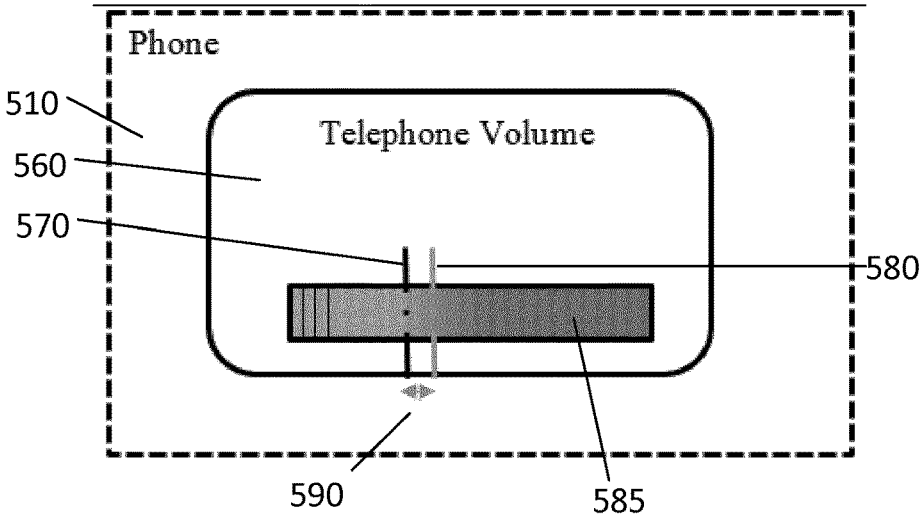

In some embodiments, step 440 comprises outputting an indication of the excess external audio volume to one or more occupants of the vehicle 100. The indication may be one of visually output, audibly output, output as a tactile signal, or a combination thereof. FIG. 5, described below, illustrates visual notifications according to embodiments of the invention.

In some embodiments, step 440 comprises determining whether any vehicle apertures, such as windows, sunroof, folding (or otherwise opening) roof of the vehicle 100 are at least partially open. If any vehicle apertures are at least partially open, step 440 may comprise at least partially closing one or more of the vehicle apertures. For example, if it is determined that one window of the vehicle 100 is open, then in step 440 the aperture member of the window may be repositioned, such as by the controller 200 initiating operation of a window closing motor, in order to decrease the size of opening of the vehicle aperture to thereby reduce the external audio volume. The one or more aperture members may be repositioned in order to decrease the size of opening of the associated vehicle apertures in one embodiment until the external audio volume falls below the external volume threshold. In other embodiments, the one or more vehicle apertures may be completely closed.

In some embodiments, step 440 comprises controlling a volume of the audio signal output by at least some of a plurality of audio output means. In some embodiments, a volume of audio output by each of the plurality of audio output means is reduced.

Where the audio output means comprises a plurality of audio output devices, such as the audio output devices 145, 146 147 associated with the first zone, the volume of the audio signal output by at least some of the audio output devices 145, 146 147 may be controlled to reduce the external volume. In one embodiment, the volume of one or more audio devices proximal to a periphery of the vehicle 100 is reduced. Proximal to the periphery may be understood to mean those audio output devices nearest an extremity or outer surface of the vehicle's body, such as those audio output devices arranged within doors of the vehicle 100 or proximal to windows of the vehicle 100, such as mounted within a dashboard of the vehicle 100, as these may contribute most to the external volume. In one embodiment, step 440 comprises selectively deactivating audio devices other than those associated with one or more seating positions of the vehicle. Thus in some embodiments all audio devices which are not associated with a seating position area deactivated. Associated with a seating position may be understood to mean those audio devices mounted upon or within the seat of the seating position. In one embodiment, step 440 comprises causing audio to be output only from one or more audio devices 145, 146 associated with one or more headrests of the vehicle 100. In this way, the audio is provided more directly to the occupant's ears and therefore may be provided at a lower volume, thereby reducing the external audio volume.

In some embodiments, step 440 comprises controlling an amplitude of one or more frequency bands of the audio signal output by at least some of the plurality of audio output means. For example, the volume or amplitude of one or more lower frequency bands of the audio signal may be reduced. Reducing the volume of lower frequency bands may be particularly effective due to a more penetrative nature of lower frequency signals i.e. through materials of the vehicle, such as sound deadening materials, interior panels and other trim of the vehicle, and through a skin of the vehicle itself. It will also be realised that a volume of one or more higher frequency bands may be reduced, which may be effective in some types of vehicle. In some embodiments, step 440 comprises controlling a frequency profile of the audio signal output by at least some of the plurality of audio output means. As noted above, the frequency profile may be controlled to reduce an amplitude of one or more low frequency bands in the audio signal, although in other embodiments, one or more high frequency bands may be reduced.

Thus as a result of step 440 the external audio volume is reduced.

FIG. 5(*a*) illustrates a display screen 510 located within the vehicle 100 which is operatively arranged to output a notification 520 thereon indicative of a volume of a telephone conversation within the vehicle 100 being externally audible. The notification may comprise a user selectable control 530 which may be activated by an input received from an occupant of the vehicle 100. The control 530 may be activated by an occupant of the vehicle pressing a corresponding portion of the display screen 510 where the display screen is touch-sensitive to receive the user input, or via another control such as a button which may be activated by the occupant.

FIG. 5(*b*) illustrates the display screen 510 having operatively displayed thereon a graphical representation 540 of an external volume of a telephone conversation within the vehicle 100 according to an embodiment of the invention. The graphical representation comprises an indicator 541 representative of the external volume. The indicator 541 in FIG. 5(*b*) is circular. The indicator 541 may vary in colour representative of the external volume. In some embodiments the indicator 540 comprises audio step indications 545 indicative of each of a plurality of steps by which volume of the telephone conversation may be adjusted. The display screen 510 in FIG. 5(*b*) further comprises an indication 550 of the external volume threshold, such as determined in step 430. As noted above, the external volume threshold may be predetermined in some embodiments, however in other embodiments the external volume threshold may be dynamic based on one or more parameters associated with the vehicle 100. Thus the indication 550 of the external volume threshold may dynamically move according to an operating state of the vehicle, such as a speed of the vehicle 100, as described above. As illustrated in FIG. 5(*b*) the indication of the external volume 541 exceeds the indication 550 of the external volume threshold denoting that the telephone conversation is audible outside the vehicle 100.

FIG. 5(*c*) illustrates the display screen 510 having operatively displayed thereon a graphical representation 560 of an external volume of a telephone conversation within the vehicle 100 according to an embodiment of the invention. The representation 560 comprises an indicator representative of the external volume in the form of a first marker 570. The representation 560 comprises an indication of the external volume threshold in the form of a second marker 580. The first and second markers 570, 580 are displayed in relation to a graphical volume representation 585 which may vary in colour from low volume to high volume. The representation 560 further comprises a differential indication 590 indicative of a difference between the external volume 570 and the external volume threshold 580.

Figure 6:
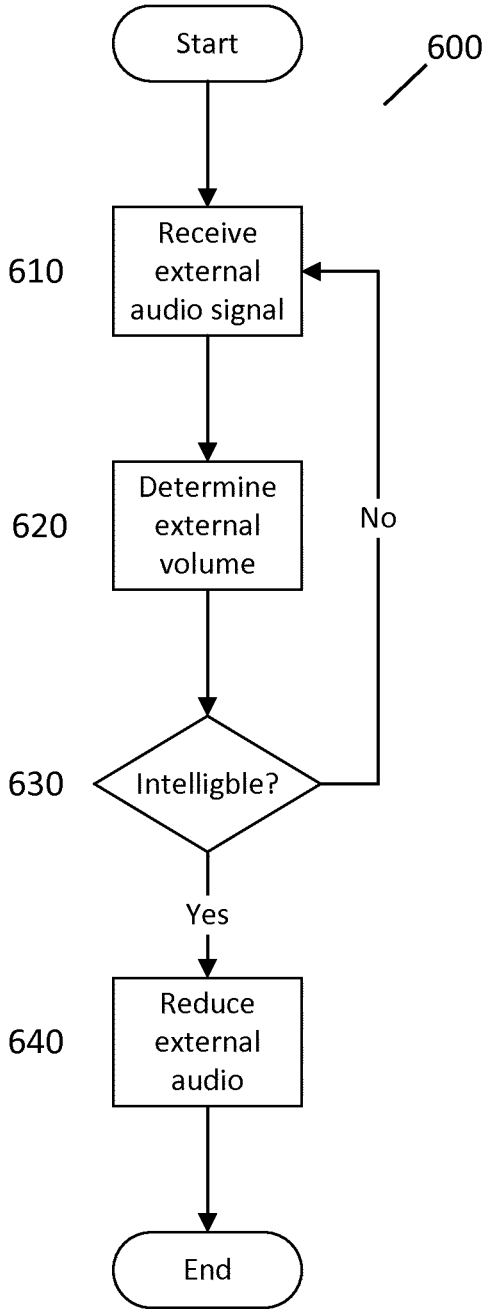
FIG. 6 shows a further method according to an embodiment of the invention.

FIG. 6 illustrates a further method 600 according to an embodiment of the invention. The method 600 is a method of enhancing in-vehicle privacy. In particular, the method is a method of reducing a likelihood of a conversation with a remote party being intelligible external to the vehicle 100. The method 600 may be performed by the system 201 and controller 200 described above in connection with FIGS. 2 and 3. The method 600 unless otherwise described shares the features of the method 400 shown in FIG. 4 and described above. Therefore repetition will be avoided and the reader is directed to the above description for further information.

The method 600 comprises a step 610 of receiving an external audio signal. The external audio signal may be the signal output by the external microphone 190. Step 610 may comprise receiving the internal audio signal indicative of audio output within the vehicle 100, as described above.

The method 600 comprises a step 620 of determining a volume of external audio. As noted above, external audio may be understood to mean audio external to the vehicle 100 which is contributed by audio output within the vehicle 100. In some embodiments, step 620 comprises determining a correspondence between the external audio signal and the internal audio signal received in step 610. Step 620 may comprise comparing the external audio signal and the internal audio signal. The comparison may comprise determining a portion of the external audio signal which corresponds to the internal audio signal, thereby identifying audio external to the vehicle having originated within the vehicle 100.

Step 630 of the method 600 comprises estimating speech intelligibility external to the vehicle 100. In particular, step 630 comprises estimating an external intelligibility of speech of the remote party which is output within the vehicle 100. Step 630 may be performed by the SIM 340 shown in FIG. 3.

Returning to the SIM 340, in some embodiments the SIM 340 receives the signal from the microphone 190 indicative of audio external to the vehicle 100. The SIM 340 is arranged to determine the estimate of speech intelligibility external to the vehicle 100 in dependence thereon. It will be appreciated that step 630 is not inextricably linked to embodiments of the invention including the SIM 340. That is, step 630 may be performed by another entity.

The estimate of speech intelligibility may be an Articulation Index (AI). The AI is an acoustical index which is used to estimate or predict a speech recognition ability of a person listening to speech. Step 630 may comprise determining the AI based on the signal from the microphone 190. In some embodiments, the AI is determined based upon the portion of the external audio signal from the microphone which is determined in step 620 which corresponds to the internal audio signal. The AI may be determined by dividing a predetermined frequency spectrum into a plurality of bands, such as 20 bands although other numbers of bands may be used. The bands may range between first and second lower and upper frequency limits, such as 200 and 6300 Hz, although it will be appreciated that other limits may be used.

In some embodiments, the AI is calculated as:

$$AI = \sum_{i=1}^{n} W_i \left[ \frac{(SNR_i + n)}{30} \right]$$

Where $W_i$ is a weight given to each frequency band indicative of the importance of that band to speech recognition, $SNR_i$ is a speech-to-noise ratio in band i, which may be determined as a difference between a root-mean-square (rms) speech level and an rms noise level and n is a predetermined value to represent a peak speech level, which may be a value of 12. It will be noted that $W_i$ does not have to be equal for all bands and that a different value of $W_i$ may be used for each band.

It can be appreciated that the bracketed quantity in the above equation ranges in value from 0 to 1 and, if 20 bands are used, each band may have a weighting of 0.05, such that AI is determined as a value between 0 and 1 although it will be appreciated that other numbers of bands and weightings may be used resulting in other upper and lower limit values.

In step 630 it is determined whether the estimate of speech intelligibility external to the vehicle 100 exceeds a threshold. In some embodiments, step 630 comprises determining whether the AI value exceeds the threshold. In some embodiments the threshold is a predetermined threshold. In some embodiments, the threshold is determined in dependence on one or more parameters associated with the vehicle. However in other embodiments the threshold is dynamically determined based upon the one or more parameters. The one or more parameters may comprise a speed of the vehicle 100, a location of the vehicle 100, a speed of an engine and/or motor of the vehicle, as described above in connection with step 430 shown in FIG. 4 to which the reader is directed.

In step 630, if the estimate of speech intelligibility external to the vehicle 100 is determined to be less than the threshold, the method returns to step 610. Thus no action may be taken if the estimate of speech intelligibility is not equal to or greater than the threshold. If, however, in step 630 the estimate of speech intelligibility is equal to, or exceeds, the threshold, the method moves to step 640.

Step 640 comprises initiating one or more actions for reducing the volume of the audio external to the vehicle 100. The one or more actions may comprise those described above in connection with step 440. Thus the action may comprise outputting an indication of the external speech intelligibility to one or more occupants of the vehicle 100. The indication may be visually output, such as shown in FIG. 5. The action may, in some embodiments, comprise at least partially closing one or more apertures of the vehicle, as described above. In some embodiments the action comprises controlling a volume of the audio signal output by at least some of a plurality of audio output means within the vehicle. In some embodiments, step 640 comprises selecting some of a plurality of audio output devices within the vehicle to use for audio output, as described above.

Figure 7:
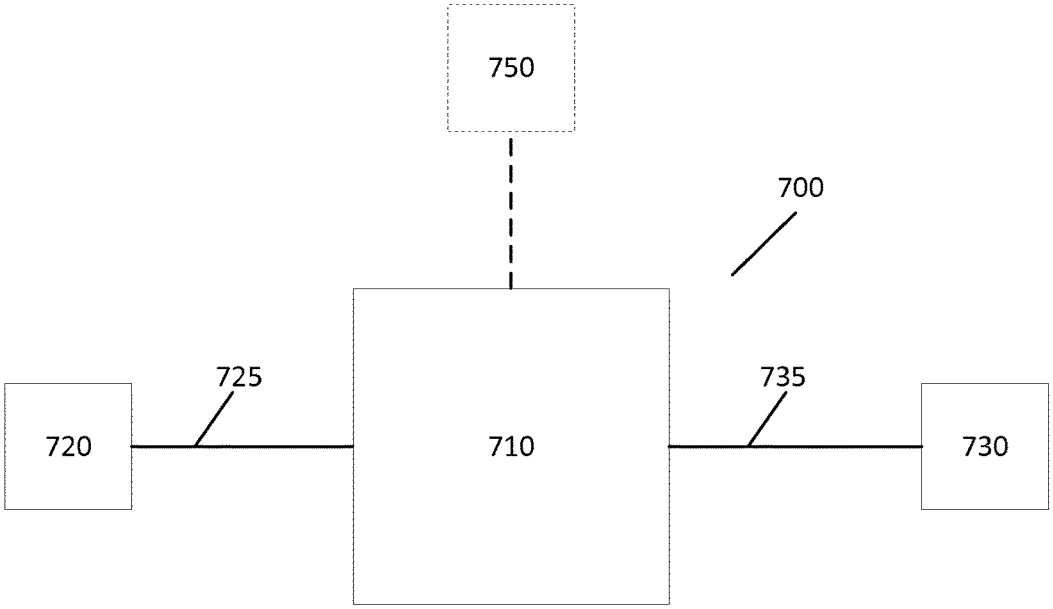
FIG. 7 shows a system according to another embodiment of the invention.

FIG. 7 illustrates an embodiment of a system 700 in accordance with the invention. The system 700 may be a vehicle privacy system 700. The vehicle privacy system 700 is arranged to, in use, reduce an external appreciability of audio from within a vehicle. It will be understood that references to external and internal are with respect to a cabin of the vehicle i.e. an occupant compartment, or portion of the vehicle in which one or more occupants are intended to reside during normal use of the vehicle. In particular, the vehicle privacy system 700 is arranged to, in use, effectively reduce an amplitude of audio from within the vehicle which is appreciable external to the vehicle. The effective reduction in amplitude may be achieved, in some embodiments, by outputting to be at least partly audible external to the vehicle, external to the cabin of the vehicle, an output audio signal which is determined to cancel or mask audio from within the vehicle i.e. from within the cabin of the vehicle. The audio may be caused by the one or more occupants, such as spoken by the one or more occupants, or output electrically within the cabin for the one or more occupants to hear. In some embodiments, the system 700 is arranged to reduce an external intelligibility of speech within the vehicle. By speech it is meant, in some embodiments, speech which is output by one or more components or systems within the vehicle, rather than words spoken by a person within the vehicle. The speech may be audio from a remote party which is output within the vehicle, such as wirelessly received by a communication system 750 of the vehicle.

In some embodiments, the system 700 may be used to reduce external audio such as in steps 440, 640 of the methods illustrated in FIGS. 4 and 6, although it will also be appreciated that the system may operate without a prior threshold determination such as in steps 430, 630 of the methods illustrated in those Figures. In other words, the system 700 of FIG. 7 may operate in anticipation of external audibility from the vehicle.

The system 700 comprises audio source means 710 which is arranged to operably output an external audio signal 735. The audio source means 710 comprises an electrical output for outputting the external audio signal 735 as an electrical signal.

As will be explained in more detail below, the audio source means 710 may be a controller 710 of the vehicle privacy system 700. The controller 710 may be implemented as an electronic device comprising one or more processors operative to execute computer software instructions which may be stored in a memory accessible to the one or more processors, such as a memory device of the controller 710. It will also be appreciated that the controller 710 may be implemented in other ways, such as an Application Specific Integrated Circuit (ASIC), for example.

The system 700 further comprises audio input means 720 which operably outputs an external audio signal 725. The external audio signal 725 is indicative of audio from within the vehicle which is at least partly appreciable external to the vehicle.

The audio input means 720 may comprise one or more vibro-acoustic audio input devices, such as microphones, for outputting the external audio signal 725 corresponding to the audio i.e. received sound waves. The audio may be received by the one or more devices internal to the vehicle, such as within an occupant compartment thereof, or may be audio external to the vehicle, such as proximal to an exterior of the vehicle. Thus the one or more audio input devices 720 may be arranged to determine sound waves internal or external to the vehicle. In some embodiments the system 700 may comprise a plurality of vibro-acoustic audio input devices 720 each arranged to provide a respective external audio signal 725, as will be explained.

In other embodiments, the audio input means 720 comprises an electrical input for receiving a signal corresponding to the external audio signal 725. In some embodiments, the external audio signal may be received from a communication system 750 or a voice output system, such as a computer-based personal assistant system or text-to-speech system, for example one which reads received electronic communications, associated with the vehicle. In one example the communication system may be a "hands-free" communication system 750 of the vehicle which may be operably coupled to at least one mobile device, such as a mobile telephone. The communication system may also by a Voice Over IP (VOIP) communication system where voice signals are digitally encoded and communicated with the vehicle over a data network. The communication system 750 is indicated in FIG. 7, although it will be appreciated that this does not itself form part of the system 700. The audio input means 720 may be provided by the controller 710 being communicably coupled to a communication bus of the vehicle to exchange, i.e. to send and/or receive data, with other units or modules communicably coupled with the communication bus. The communication bus may be implemented by, for example, a communication network of the vehicle such as one of CAN bus, Ethernet or Flexray, although other bus protocols may be envisaged. Thus the external audio signal 725 may be received at the controller 710 via the communication bus.

The audio source means 710 is arranged to receive the external audio signal 725 and to determine the audio signal 735, hereinafter output audio signal 735, in dependence thereon. The output audio signal 735 is determined by the audio source means 710 to mitigate the external audio from within the vehicle. In particular, in some embodiments, the audio source means 710 is arranged to render speech from within the vehicle at least less intelligible, or substantially unintelligible, external to the vehicle. The reduction in intelligibility may be provided by sound waves corresponding to the output audio signal 735 being at least party emitted external to the vehicle to interfere or at least partly cancel or mask sound waves corresponding to the speech.

The system 700 comprises audio output means 730 for outputting audio, i.e. sound waves, which are at least partly audible external to the vehicle. The audio output means 730 is arranged to receive the output audio signal 735 from the audio source means 710 and to output audio corresponding thereto. The audio, or sound waves, output by the audio output means 730 may, in some embodiments, be directed primarily to the exterior of the vehicle. However in other embodiments, the audio output means 730 may be arranged to output audio internal to the vehicle which is partly appreciable externally i.e. may be at least partly heard outside the vehicle. The audio output means 730 may comprise one or more audio output devices 730, such as speakers, for outputting audible sounds based on received electrical signals, as will be appreciated. In some embodiments, at least some of the audio output devices 730 may be externally directed, such as mounted proximal to the exterior of the vehicle. Such externally directed audio output devices 730 may be mounted behind body panels, external trim or fascia of the vehicle. For example, a speaker may be mounted within a wheel arch of the vehicle, such as behind a wheel arch liner of the vehicle which serves to provide protection to the speaker, although it will be appreciated that other locations may be used such as, for example, within an engine bay, behind a door skin or behind a bumper of the vehicle.

The audio source means 710 is arranged to receive the external audio signal 725 and to determine the output audio signal 735 to externally at least partly cancel audio from within the vehicle. The audio source means 710 is arranged to determine the output audio signal 735 as an external sound cancellation signal for at least a portion of the external audio signal. The audio source means 710 may apply at least one transfer function to the external audio signal 725 to determine the output audio signal 735. The transfer function may represent a change to the audio from within the vehicle as compared to that audible external to the vehicle i.e. represent the change in sound waves caused by travelling through a structure and/or parts of the vehicle, such as monocoque, body, windows etc., of the vehicle. The audio source means 710 may be arranged to determine the output audio signal 735 to generally be an inverse to the external audio signal, such that at least some cancellation is achieved, of sound waves emanating from within the vehicle. By emanating it is meant originating within the cabin but which is audible, at least partly, outside i.e. external to the cabin. In this way audio, in particular speech, within the vehicle is less intelligible external to the vehicle. However in other embodiments, the output audio signal 735 may be determined to interfere with the emanated audio such that the speech within the vehicle is less intelligible external to the vehicle.

In some embodiments, the audio source means 710 may be arranged to identify a speech portion or component of the external audio signal. The speech component may be that component of the external audio signal between first and second predetermined frequencies. The first and second predetermined frequencies may be 200 Hz and 20 KHz, respectively, although it will be appreciated that other frequencies may be used. In this way, the output audio signal 735 is determined for the portion of the external audio signal most likely to contain speech.

An example will be described wherein the audio input means 720 comprises a microphone 720 arranged to output the external audio signal 725 corresponding to sound waves within the vehicle, and the audio output means 730 comprises a speaker arranged to direct output audio external to the vehicle.

In use, the audio source means 710 receives the external audio signal 725 from the microphone 720 which is indicative of sound waves within the vehicle. The audio source means 710 is arranged to process the external audio signal 725 to determine the output audio signal 735 which, when output, will interfere destructively with sound waves emanating from the vehicle. The processing may comprise the audio source means 710 applying a transfer function to the external audio signal 725, where the transfer function is indicative of the change in the sound waves caused by travelling through the structure of the vehicle, which it will be appreciated may include non-structural components, such as body panels, windows, interior trim etc. of the vehicle. The processing may also include the audio source means 710 determining the output audio signal 735 as a signal to cancel the sound emanating from the vehicle, such as representing an inverse of the emanated sound. Therefore, the processing performed by the audio source means 710 may comprise at least a first part where the sound of the audio external to the vehicle is determined, and a second part where a signal which interferes or cancels with the sound is determined. It will be appreciated that where the audio input means 720 comprises a microphone 720 arranged to output the external audio signal 725 corresponding to sound waves external to the vehicle, the first part of the processing may not be required, or may be reduced, since the sound is already determined or measured external to the structure of the vehicle.

In some embodiments, a first microphone may be arranged to determine a first external audio signal 725 corresponding to audio within the vehicle and a second microphone is arranged to determine a second external audio signal corresponding to audio external to the vehicle. The audio source means 710 is arranged to receive both the first and second external audio signals and, by comparison thereof, to identify audio from within the vehicle which is emanating from the vehicle to be externally audible. The audio source means is then arranged, as described above, to determine the output audio signal 735 to interfere destructively with sound waves emanating from the vehicle as determined from the comparison.

As described above, the audio output means 730 may comprise one or more audio output devices 730. In some embodiments, the one or more audio output devices 730 may comprise speakers for outputting audible sounds based on received electrical signals. However, in some embodiments of the invention, the one or more audio output means 730 comprises one or more vibration means or exciting means for causing vibration of, or exciting, at least a portion of the vehicle to output audio at least partly external to the vehicle. The vibration means may be arranged to operably cause the portion of the vehicle to vibrate such that sound waves are formed responsive to the vibration. The vibration means may comprise an electro-mechanical device for causing the portion of the vehicle to vibrate in dependence on the received electrical signal. The portion of the vehicle may comprise one or more external surfaces of the vehicle. The portion may be a body panel of the vehicle, such as a door panel, although other panels may be alternatively or additionally excited. The portion of the vehicle may comprise other generally planar portions, such as a bumper or other external surface of the vehicle.

Figure 8:
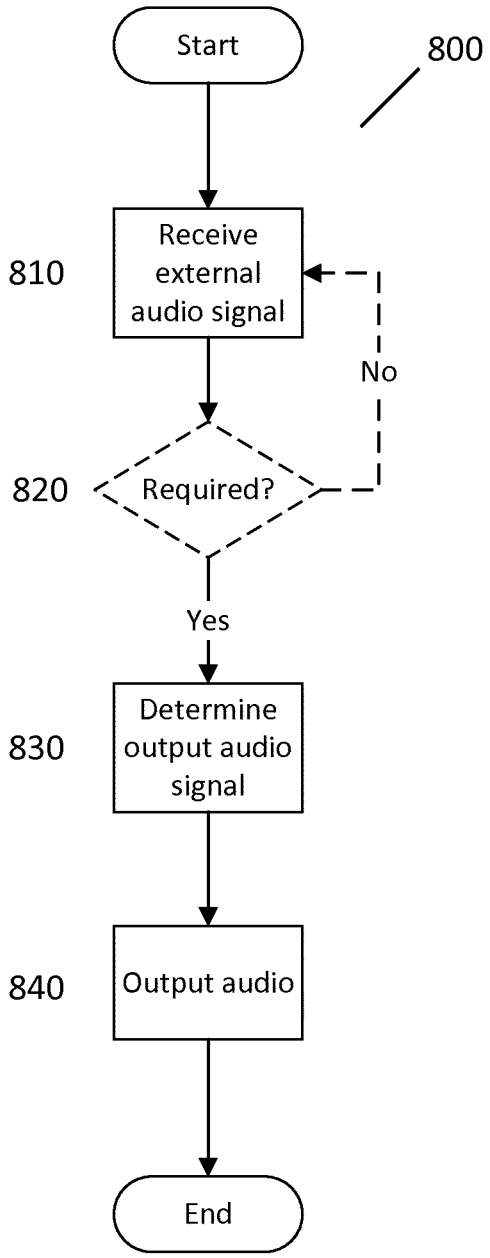
FIG. 8 illustrates a method according to an embodiment of the invention.

FIG. 8 illustrates a method 800 according to an embodiment of the invention. The method 800 may be performed by the system 700 described above with reference to FIG. 7. The method 800 may be a method 800 of reducing intelligible audio external to a vehicle.

The method 800 comprises a step 810 of receiving a signal 725 indicative of audio from within a vehicle. The signal may be determined at a location either internal to, or external to, the vehicle or be provided from a system associated with the vehicle from which the audio within the vehicle is output, such as a communication system of the vehicle. The signal may be an external audio signal 725 which may be received from audio input means 720. It will be noted that the external audio signal is not necessarily a measurement or representation of the audio external to the vehicle, but may be a measurement or representation of audio which causes audible signals external to the vehicle, such as audio within the vehicle or an electrical signal which, when audibly output, causes audio which is audible external to the vehicle.

In step 820, which is an optional step of the method 800, it is determined whether it is necessary, or desirable, to reduce an external intelligibility of speech from within the vehicle. In some embodiments, an audio signal is selectively output for reducing an external intelligibility of speech within the vehicle in dependence on the determination in step 820. Step 820 may comprise determining whether the volume or amplitude of the signal received in step 810 exceeds a predetermined volume or amplitude, or whether an estimated volume or amplitude of audio external to the vehicle exceeds a predetermined volume or amplitude. In other embodiments, step 820 comprises estimating speech intelligibility external to the vehicle.

The estimate of speech intelligibility may be an Articulation Index (AI). The AI is an acoustical index which is used to estimate or predict a speech recognition ability of a person listening to speech. Step 820 may comprise determining the AI based on the external audio signal. Further details of the determination of the AI are provided above in connection with some embodiments of the invention, to which the reader is directed to avoid repetition. In some embodiments of step 820 it is determined whether the estimate of speech intelligibility external to the vehicle 100 exceeds a threshold. In some embodiments, step 820 comprises determining whether the AI value exceeds the threshold. As described above, the threshold may be a predetermined threshold or a dynamically determined threshold which may be determined based upon one or more parameters associated with the vehicle.

If it is determined that it is not necessary, or desirable, to reduce the external intelligibility of speech within the vehicle in step 820, the method returns to step 810. If, however, it is necessary, or desirable, to reduce the external intelligibility of speech within the vehicle, the method moves to step 830.

Step 830 comprises determining the output audio signal 735. Step 830 may comprise determining the output audio signal 735 in dependence on the signal received in step 810, such as the external audio signal 725. The output audio signal 735 may be determined to interfere destructively with sound waves emanating from audio output means within the vehicle.

Step 830 may comprise, in some embodiments, applying at least one transfer function to the external audio signal 725. The transfer function may be indicative of the change in the sound waves output within the vehicle caused by travelling through the structure of the vehicle, which includes non-structural components, such as body panels, windows, interior trim etc. of the vehicle. The audio output signal 735 may be determined as a signal to cancel the sound emanating from the vehicle, such as representing an inverse of the emanated sound, in order to at least partly cancel the sound emanating from the vehicle. A different transfer function may be applied to each of a plurality of external audio signals, since each audio signal may be determined with respect to a different location within the vehicle.

Step 840 comprises outputting audio corresponding to the output audio signal 735 as determined in step 830. Step 840 may comprise providing the output audio signal 735 to one or more output means for outputting audio i.e. sound waves corresponding thereto which are at least partly audible external to the vehicle.

Figure 9:
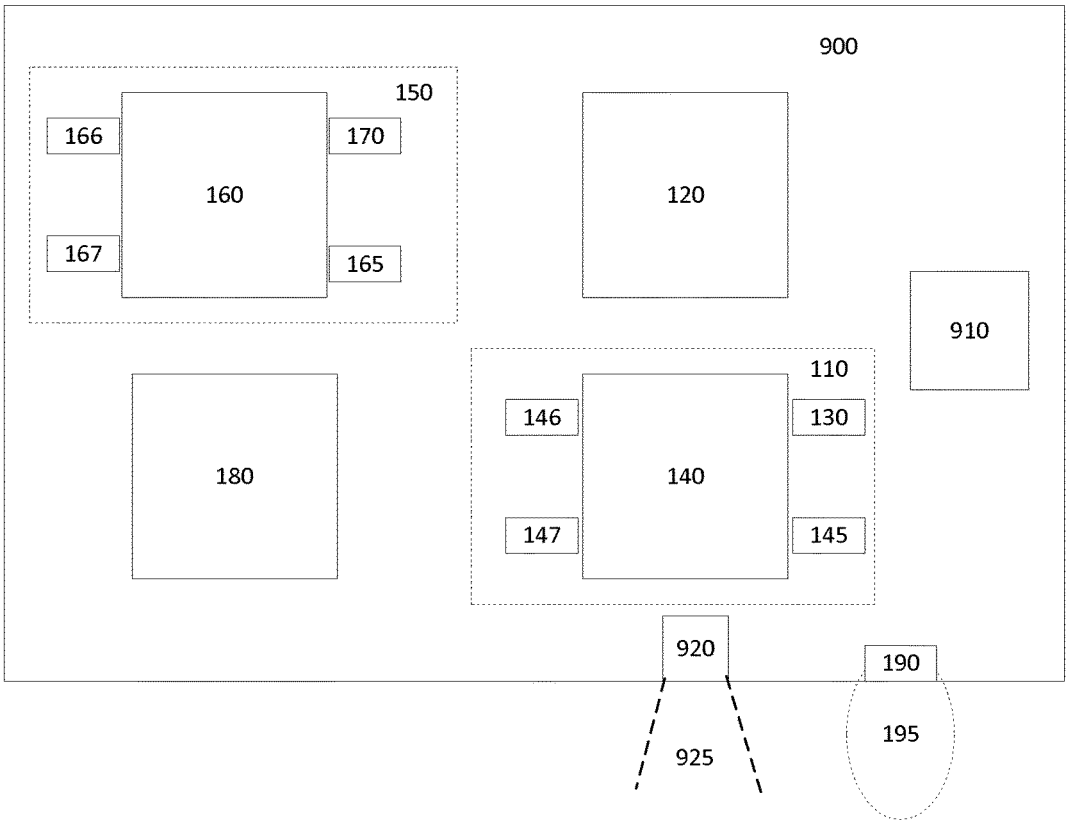
FIG. 9 shows a system according to another embodiment of the invention.

FIG. 9 illustrates a vehicle 900 according to an embodiment of the invention. The vehicle 900 is illustrated as comprising some parts sharing consistent reference numerals as that shown in FIG. 1 and repeat description of these parts will be omitted for clarity. However it will be appreciated from the description below that not all of these illustrated parts shown in FIG. 9 are essential to embodiments of the invention. The vehicle 900 comprises a system which operatively implements the method described above with reference to FIG. 8.

The vehicle 900 comprises an audio source means 910, which may be in the form of a controller 910. The controller 910 is arranged to control one or more audio output means 145, 146, 147, 920 for outputting audio 925 to be at least partly audible external to the vehicle 900. The audio 925 is output by the audio output means 145, 146, 147, 920 for reducing an external intelligibility of speech output within the vehicle 900.

The controller 910 is provided with an external audio signal 725 indicative of audio from within the vehicle 900. The external audio signal 725 may be provided from one or more audio input means 130 which is provided for outputting an electrical signal indicative of the audio from within the vehicle 900. The external audio signal 725 may be provided from a vibro-acoustic device such as one or more microphones. The audio may be audio within a first zone 110 of the vehicle. The audio input means 130 may be a first microphone 130. Similarly, in the illustrated embodiment, a second zone 150 may comprise a second audio input means 170. The second audio input means 170 is provided for outputting an electrical signal indicative of audio within the second zone 150. The audio input means may be a second microphone 170. The first and second microphones 130, 170 may be used for facilitating a call with a remote party. However, in other embodiments, the external audio signal 725 may be provided from one or more audio input means 190 which is provided for outputting an electrical signal indicative of the audio from outside 195 the vehicle 900, as indicated in FIG. 9.

As described above, some of the audio output means 145, 146, 147 may arranged to output audio predominantly to an occupant of each of one or more respective zones 110, 150 within the vehicle 900. In embodiments of the invention, the audio output means used with embodiments of the invention may be those audio output means located proximal to a periphery of the vehicle 900, such as speakers mounted within doors or adjacent windows of the vehicle 900. As illustrated in FIG. 9, the vehicle comprises at least one audio output means 920 arranged to output audio predominantly external to the vehicle 900. In the illustrated embodiment the audio output means 920 is a speaker directed externally from the vehicle 900. The speaker 920 may be mounted in a wheel arch area of the vehicle, for example. The audio output means 920 may be an exciting means 920 arranged to excite a portion of the vehicle's external surface, such as a body panel e.g. a door panel of the vehicle 900. The audio output means 920 is arranged to output audio i.e. sound waves 925 external from the vehicle 900 for reducing an external intelligibility of speech within the vehicle 900.

Figure 10:
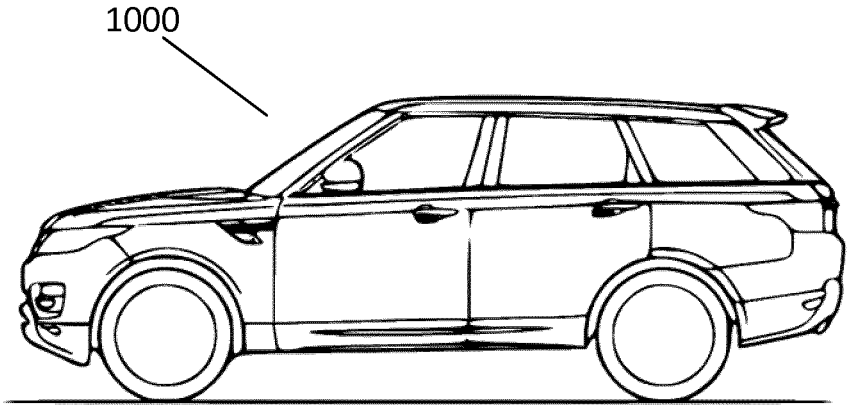
FIG. 10 shows a vehicle according to an embodiment of the invention.

It can be appreciated that embodiments of the invention aim to address a problem of external audio audibility associated with vehicles. A vehicle 1000 according to an embodiment of the invention is shown in FIG. 10. The vehicle 1000 is a land-going vehicle, such as a wheeled or tracked vehicle, although it will be appreciated that embodiments of the invention are not limited in this respect and may be used with watercraft and aircraft. The vehicle 1000 may comprise an in-vehicle privacy system 100 such as shown in FIGS. 1 & 2 or a controller 200 such as shown in FIG. 3. The vehicle 1000 may be arranged to perform a method 400, 600 according to an embodiment of the invention such as illustrated in one or both of FIGS. 4 & 6. The vehicle 1000 may comprise a system 700 such as shown in one or both of FIGS. 7 and 9 or be arranged to perform a method 800 according to an embodiment of the invention such as illustrated in FIG. 8.

It will be appreciated that embodiments of the present invention can be realised in the form of hardware, software or a combination of hardware and software. Any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are embodiments of machine-readable storage that are suitable for storing a program or programs that, when executed, implement embodiments of the present invention. Accordingly, embodiments provide a program comprising code for implementing a system or method as described above and a machine readable storage storing such a program. Still further, embodiments of the present invention may be conveyed electronically via any medium such as a communication signal carried over a wired or wireless connection and embodiments suitably encompass the same.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed. The claims should not be construed to cover merely the foregoing embodiments, but also any embodiments which fall within the scope of the claims.

The invention claimed is:

1. A vehicle privacy system, comprising:

an audio input arranged to receive an external audio signal indicative of audio externally emanating from within a cabin of a vehicle;

an audio source arranged to receive the external audio signal and determining an output audio signal based thereon for reducing an external intelligibility of speech within the cabin of the vehicle; and an audio output arranged to receive the output audio signal and outputting audio corresponding thereto to be at least partly audible external to the cabin of the vehicle.

2. The system of claim 1, further comprising a control device arranged to selectively cause the audio output to output audio corresponding to the output audio signal.

3. The system of claim 2, wherein the control device is further arranged to determine a speech intelligibility external to the vehicle and cause the audio source to output the output audio signal to the audio output based on the determination of the speech intelligibility.

4. The system of claim 1, wherein the audio input is arranged to determine audio internal to the cabin of the vehicle.

5. The system of claim 1, wherein the audio input is arranged to determine audio external to the cabin of the vehicle.

6. The system of claim 1, wherein the audio input is arranged to receive the external audio signal from a communication system or a voice output system.

7. The system of claim 6, wherein the communication system is selected from a group consisting of: a telephony communication system, a Voice Over IP, VOIP, communication system, and a text-to-speech communication system.

8. The system of claim 1, wherein the audio source is further arranged to determine the output audio signal as an external sound cancellation signal for at least a portion of the external audio signal.

9. The system of claim 8, wherein the portion of the external audio signal is a portion corresponding to speech within the cabin of the vehicle.

10. The system of claim 1, wherein the audio output comprises one or more audio outputs arranged to output audio predominantly external to the cabin of the vehicle.

11. The system of claim 1, wherein the audio output comprises vibration means for vibrating at least a portion of the vehicle to output audio external to the vehicle.

12. The system of claim 11, wherein the vibration means is arranged to vibrate either or both of at least one structure of at least a portion of the vehicle and at least one external surface of the vehicle.

13. The system of claim 11, wherein:

the structure of at least the portion of the vehicle comprises a structure of a door of the vehicle; and the one or more external surfaces of the vehicle comprise one or more body panels or windows of the vehicle.

14. A vehicle comprising a system as claimed in claim 1.

15. A method, comprising:

determining an external audio signal corresponding to audio externally emanating from within a cabin of a vehicle;

determining an output audio signal based on the external audio signal for reducing an external intelligibility of speech within the cabin of the vehicle; and outputting audio corresponding to the output audio signal to be at least partly audible external to the cabin of the vehicle.

16. Computer software which, when executed by a computer, is arranged to perform a method according to claim 15.

17. A non-transitory, computer-readable storage medium storing instructions thereon that, when executed by one or more electronic processors, causes the one or more electronic processors to carry out the method of claim 15.

18. A controller for a vehicle privacy system, the controller comprising:

input means for receiving an external audio signal indicative of audio externally emanating from within a cabin of a vehicle;

processing means for determining an output audio signal based on the external audio signal for reducing an external intelligibility of speech within the cabin of the vehicle; and output means for outputting the output audio signal to audio output means.

19. The controller of claim 18, wherein the output audio signal is determined as a sound cancellation signal for the speech within the cabin of the vehicle.

* * * * *